US012668393B2

(12) United States Patent
Leidig et al.

(10) Patent No.: US 12,668,393 B2
(45) Date of Patent: Jun. 30, 2026

(54) DEVICE, SET AND METHOD FOR REMOVING A STERILE OBJECT FROM A FOIL BAG

(71) Applicant: Syntegon Technology GmbH, Waiblingen (DE)

(72) Inventors: Juergen Leidig, Frankenhardt (DE); Alexander Ekkart, Crailsheim (DE); Florian Weber, Crailsheim (DE); Reiner Staeudle, Rot am See (DE)

(73) Assignee: Syntegon Technology GmbH, Waiblingen (DE)

( * ) Notice: Subject to any disclaimer, the term of this patent is extended or adjusted under 35 U.S.C. 154(b) by 363 days.

(21) Appl. No.: 18/464,577

(22) Filed: Sep. 11, 2023

(65) Prior Publication Data

US 2024/0092521 A1 Mar. 21, 2024

(30) Foreign Application Priority Data

Sep. 16, 2022 (DE) ..... 10 2022 123 841.5

(51) Int. Cl.
*B65G 69/00* (2006.01)
*B65B 69/00* (2006.01)

(52) U.S. Cl.
CPC ..... *B65B 69/0008* (2013.01)

(58) Field of Classification Search
CPC ..... B65B 69/0033; B65B 69/0008; B65B 69/0041; B65B 31/041; B65B 31/08; A61M 5/002; A61M 2209/04; A61M 2209/06
USPC ..... 414/412
See application file for complete search history.

(56) References Cited

U.S. PATENT DOCUMENTS 4,779,398 A * 10/1988 Glandon ..... B65B 31/022 53/512
4,821,489 A * 4/1989 MacLeod ..... B65B 51/06 53/399
5,111,639 A * 5/1992 Bolejack ..... B65B 5/045 53/434

(Continued)

FOREIGN PATENT DOCUMENTS

CN 101687559 A 3/2010
CN 103043271 A 4/2013

(Continued)

OTHER PUBLICATIONS

Office Action for German Application No. 10 2022 123 841.5 mailed on Mar. 8, 2023, 7 pages.

(Continued)

*Primary Examiner* — Glenn F Myers
(74) *Attorney, Agent, or Firm* — Michael Best & Friedrich LLP

(57) ABSTRACT

A device (10) for removing a sterile object (12) from a foil bag (14) includes a needle unit (16) with a hollow needle (18) for piercing the foil bag (14), a gas connection (20) arranged on the needle unit (16) for introducing gas via the hollow needle (18) into the foil bag (14), a holding device (22) for holding the foil bag (14), a cutting device (24) for cutting open the foil bag (14), and a removal device (26) for removing the object (12) from the cut open foil bag (14). The holding device (22) has at least one holding unit (28), which is formed in a planar manner on the holding device (22) and is mounted movably, for contacting the foil bag (14).

19 Claims, 3 Drawing Sheets

(56) References Cited

U.S. PATENT DOCUMENTS

| | | | | |
|---|---|---|---|---|
| 2021/0114761 | A1 | 4/2021 | Pennington et al. | |
| 2022/0161958 | A1 | 5/2022 | Kupfer et al. | |
| 2022/0274248 | A1* | 9/2022 | Yoshikuwa | B25J 13/00 |

FOREIGN PATENT DOCUMENTS

| | | | |
|---|---|---|---|
| DE | 102011080289 | | 2/2013 |
| DE | 102011084302 | A1 | 4/2013 |
| DE | 102014201967 | | 8/2015 |
| JP | 2019167156 | A | 10/2019 |

OTHER PUBLICATIONS

European Patent Office Extended Search Report for Application No. 23184641.1 dated Feb. 16, 2024 (9 pages).

Chinese Patent Office Action for Application No. 202311189131.4 dated Nov. 19, 2025 (29 pages including English machine translation).

* cited by examiner

DEVICE, SET AND METHOD FOR REMOVING A STERILE OBJECT FROM A FOIL BAG

BACKGROUND

The invention relates to a device for removing a sterile object, in particular a tub, from a foil bag, a set and a method for removing a sterile object, in particular a tub, from a foil bag.

Sterile objects are used on a large scale, particularly in the medical and pharmaceutical sectors. For example, sterile disposable syringes are stored and transported in a sterile transport container sealed in a foil, the so-called tub. The sterile disposable syringes, together with the transport container or tub, must be removed from the foil packaging as sterilely as possible.

The foil packaging is usually a sealed bag which has a protruding flap of the foil material on the side. To open such a foil bag, the region of the foil bag with the flap is completely cut off or incised.

The negative pressure or vacuum that is normally present in the foil bag before it is cut open presses the foil against the transport container or tub. This often leads to the foil adhering to the transport container or tub. This can lead to problems with the foil bag detaching from the transport container or tub when the transport container or tub is removed from the foil.

To prevent the foil bag from sticking, it can be inflated with sterile compressed air before cutting. This makes it easier to cut open the foil bag and remove the transport container or tub from the foil bag. Adhesion of the foil bag to the transport container or tub is prevented as far as possible by inflating the foil bag.

A device with which such removal of a sterile transport container or tub from a foil bag is possible is known from DE 10 2011 080 289 A1.

The disadvantage of this is that the foil bag can be inflated in an uncontrolled manner. This can make it difficult to cut open the foil bag.

SUMMARY

It is therefore an object of the present invention to provide a device, a set and a method for removing a sterile object, wherein controlled inflation of the foil bag is enabled so that the foil bag is inflated in a defined shape.

This task is solved by a device for removing a sterile object from a foil bag according to the disclosure.

The object can be a transport container or tub for medical or pharmaceutical containers, such as vials or (disposable) syringes. The object can be tub-shaped.

The device comprises a needle unit with a hollow needle for piercing the foil bag. In particular, the foil bag can be hermetically sealed or welded before being pierced with the needle. A negative pressure or vacuum may be present inside the foil bag.

The device comprises a gas connection arranged on the needle unit for introducing gas via the hollow needle into the foil bag. The gas can be a sterile gas, in particular sterile compressed air. The foil bag can be inflated by the introduction of gas.

The device comprises a holding device for holding the foil bag. In this case, the holding device can engage particularly well with the foil bag in particular after the foil bag has been inflated with the gas and hold it.

The device comprises a cutting device for cutting open the foil bag. In particular, after inflating the foil bag with the gas, the cutting of the inflated foil bag can be implemented particularly well by a defined cut by means of the cutting device.

The device comprises a removal device for removing the object from the cut open foil bag. The removal device can be configured to pull the object out of the cut open foil bag. For this purpose, the removal device may have at least one, in particular several, gripping and/or suction elements.

It is equally conceivable that the removal device can be configured to push the object out of the cut open foil bag.

Removal of the object by means of the removal device can take place along a direction oriented perpendicular to the direction of gravity (along a horizontal line).

The holding device has at least one holding unit for contacting the foil bag, which is formed on the holding device in a planar, in particular flat, manner and is movably mounted. The holding unit can be pretensioned by means of at least one spring element, in particular a helical spring, in particular in the direction of gravity.

When the foil bag is inflated, it can press against the holding unit. By means of the holding unit, the foil bag can be held in a defined shape during inflation. This can facilitate both the cutting open of the foil bag and the holding of the foil bag by means of the holding unit.

According to a further embodiment of the device, the holding unit can be configured as a metal sheet. The holding unit can have a rectangular shape. This allows the holding unit to be constructed as simply and stably as possible.

According to a further embodiment of the device, the holding unit can be oriented perpendicular to the direction of gravity. In particular, the holding unit can be configured to contact an upper region of the foil bag with respect to the direction of gravity. The holding unit may extend along a plane oriented perpendicular to the direction of gravity. In this way, the holding unit can bring the upper region of the foil bag with respect to the direction of gravity into a defined, in particular flat, shape. The holding unit can quasi press the upper region of the foil bag in relation to the direction of gravity into a flat shape oriented perpendicular to the direction of gravity.

According to a further embodiment of the device, the holding device can have at least one piercing device with a piercing needle for piercing the foil bag. By means of the piercing needle of the piercing device, the foil bag can be pierced, in particular, in the upper region of the foil bag with respect to the direction of gravity. In the process, the gas introduced into the foil bag by the hollow needle can escape from the foil bag through the puncture point of the piercing needle or can be discharged by means of the puncture point of the piercing needle. The foil bag can thus be specifically vented via the puncture point of the piercing needle. This prevents excessive inflation of the foil bag, so that the foil bag can be inflated in a controlled manner.

The holding unit can have at least one opening for passing the piercing needle through the holding unit.

According to a further embodiment of the device, the piercing needle may have at least one external groove for discharging the gas introduced by the needle into the foil bag from the foil bag. The external groove may be disposed on the outer surface of the piercing needle. The external groove may have an elongated shape. The external groove may extend along the longitudinal direction of the piercing needle. The external groove may extend at least partially transverse to the longitudinal direction of the piercing needle. The external groove may facilitate discharge of the gas from the foil bag. The external groove may form a (flow) channel for the discharged gas from the foil bag. It is conceivable that by means of the shape and/or the number of the external groove(s), the discharge of the gas from the foil bag can be specifically controlled.

According to a further embodiment of the device, the holding device can comprise at least one suction unit for sucking and/or holding the foil bag. The suction unit can be configured for contacting the upper region of the foil bag with respect to the direction of gravity. The suction unit can be configured as a suction cup. In this way, the suction or holding of the foil bag can be implemented by simple means.

According to a further embodiment of the device, the needle unit may comprise a filter device for filtering the gas introduced into the foil bag by means of the needle. The filter device may be arranged within the needle unit and/or the needle. Alternatively or additionally, the filter device may be arranged within the gas connection. This can prevent impurities from being introduced into the foil bag with the gas introduced into the foil bag by the needle, thereby contaminating the sterile object.

According to a further embodiment of the device, the device may comprise a movement device. The movement device may be configured to move the needle unit and/or the needle for piercing the needle into the foil bag and retracting the needle from the foil bag. The movement device can be configured to move the needle back and forth, in particular along the direction of gravity. In this way, the insertion process can be implemented by means of the needle with simple means.

According to a further embodiment of the device, the device can have a fixing device for fixing a lateral region of the foil bag with respect to the direction of gravity. The fixing device may be configured for fixing a region of the foil bag comprising a flap of the foil bag. The fixing device may be configured for fixing a flap of the foil bag. Fixing a region of the foil bag by means of the fixing device can facilitate cutting open of the foil bag. The fixing device can be configured to be movable, in particular along the direction of gravity and/or perpendicular to the direction of gravity.

According to a further embodiment of the device, the fixing device can comprise at least two clamping elements. The two clamping elements can be configured to fix the foil bag in a clamping manner. The two clamping elements can be configured to fix the lateral region of the foil bag with respect to the direction of gravity in a clamping manner. The two clamping elements can be configured to clamp the flap of the foil bag. This means that fixing can be achieved by simple means.

In the present case, "fixing in a clamping manner" means that an element (e.g. foil bag, region of the foil bag or flap of the foil bag) is placed between two clamping elements and the two clamping elements each exert a force from opposite directions on the element placed between the two clamping elements. In other words, the two clamping members are pressed together (moved toward each other), thereby fixing the element placed between them.

The above task is further solved by a set according to the disclosure.

The set includes a device according to the above embodiments and at least one object surrounded by a foil bag. The foil bag may also be a component of the set.

The object may be a transport container or tub according to the above embodiments. The object may include at least one indentation. The indentation may be arranged on a wall of the object contacting the foil bag. The indentation may be arranged on a wall of the object oriented in particular at the bottom with respect to the direction of gravity and/or perpendicular to the direction of gravity.

The indentation may be spanned by the foil bag. The device and/or the object can be configured in such a way that the needle for piercing the foil bag is at least partially inserted or moved into the indentation of the object. The piercing of the foil bag by means of the needle can thus be facilitated. In addition, it can be prevented that the needle hits the object and thereby damages itself and/or the object.

With regard to the advantages achievable with the set, reference is made to the explanations relating to the device and/or the object in this respect. The measures described in connection with the device and/or the object and/or the measures explained below can be used for the further design of the set.

According to a further embodiment of the device, the holding unit may project beyond the object on at least one side of the object. The holding unit can project beyond the object on all sides of the object. In particular, the holding unit can project beyond the object on at least one side, in particular on all sides, of the object when viewed along the direction of gravity. In this way, the inflated foil bag can be held in a particularly preferred shape for cutting open.

The above task is further solved by a method for removing a sterile object from a foil bag according to the disclosure.

The object may be a transport container or tub according to the above embodiments.

The method includes the steps:

Providing the object arranged in the foil bag.

Piercing of the foil bag by means of a hollow needle.

Introduction of gas via the hollow needle into the foil bag.

Holding the foil bag by means of a holding device, the holding device having at least one holding unit, which is formed on the holding device in a planar, in particular flat, manner and is movably mounted, for contacting the foil bag.

Contacting the foil bag by means of the holding unit. In particular, the holding unit can contact an upper region of the foil bag in relation to the direction of gravity.

After contacting the foil bag by means of the holding unit, further introduction of gas via the hollow needle into the foil bag so that it is further inflated and the holding unit moves. The foil bag can move the holding unit in particular with its upper region in relation to the direction of gravity. In particular, the foil bag can move the holding unit against the direction of gravity.

According to a further embodiment of the method, the method may comprise the step of:

During the introduction of gas via the needle into the foil bag, piercing of the foil bag to discharge the gas introduced by the needle into the foil bag from the foil bag. In this case, the piercing of the foil bag can be implemented in particular in the upper region of the foil bag with respect to the direction of gravity.

According to a further embodiment of the method, the method may comprise the steps of:

Cutting open the foil bag inflated by the hollow needle and held by the holding device. In particular, the cutting can be carried out by means of a cutting device.

Removal of the object from the foil bag. The removal of the object can be implemented in particular by means of a removal device.

In particular, disposal of the empty and cut open foil bag.

According to a further embodiment of the method, a device according to the above embodiments and/or a set according to the above embodiments may be used to carry out the method.

With regard to the advantages achievable with the method, reference is made to the explanations concerning the device and/or the set. The measures described in connection with the device and/or the set and/or the measures explained below can be used for the further design of the method.

BRIEF DESCRIPTION OF THE DRAWINGS

Further features, details and advantages of the invention are apparent from the wording of the claims and from the following description of an embodiment example based on the drawings. Showing:

DETAILED DESCRIPTION

In the following description and in the figures, the corresponding components and elements have the same reference signs. For the sake of clarity, not all reference signs are shown in all figures.

Figure 1:
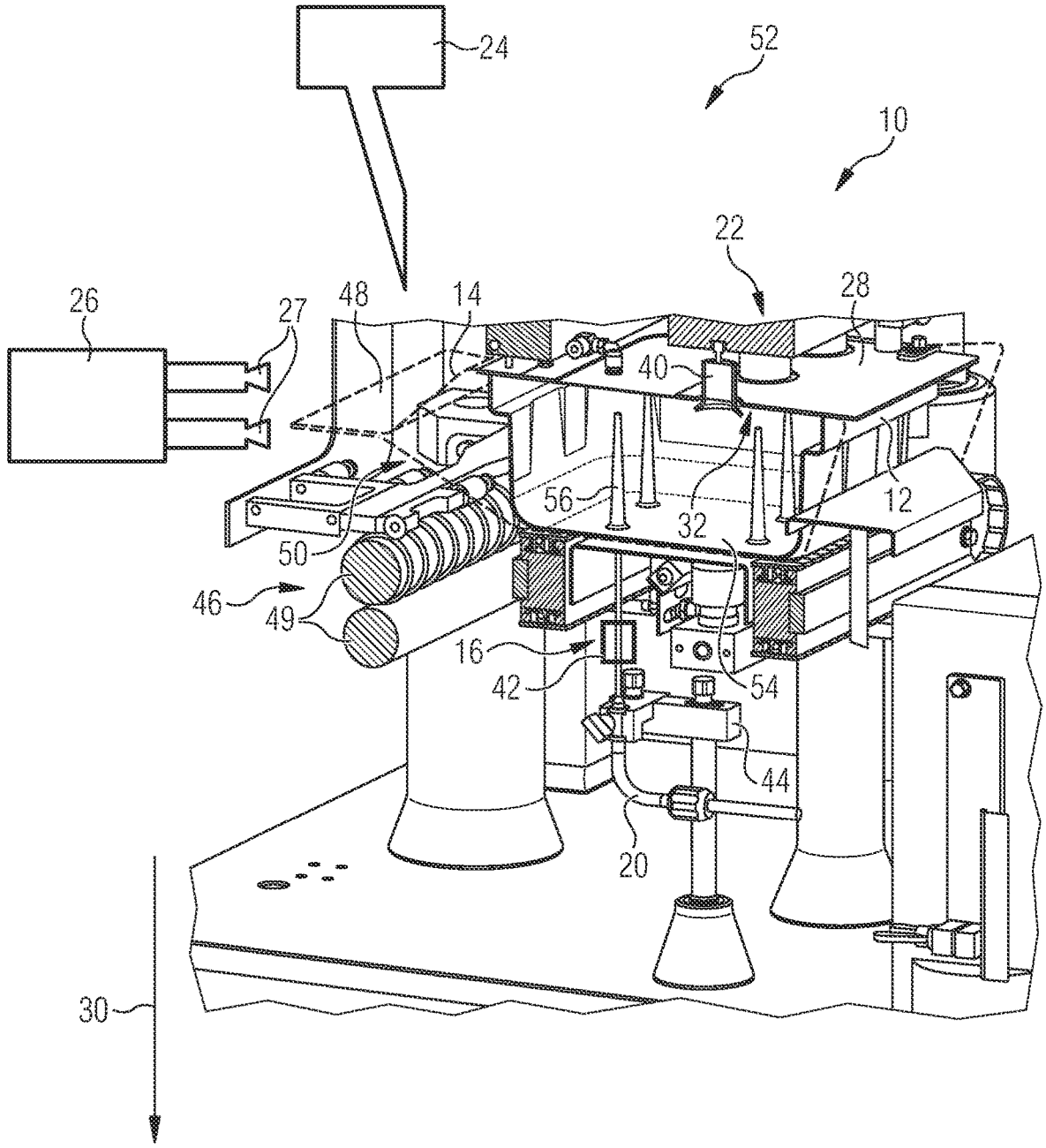
FIG. 1 a perspective view of a device.
Figure 2:
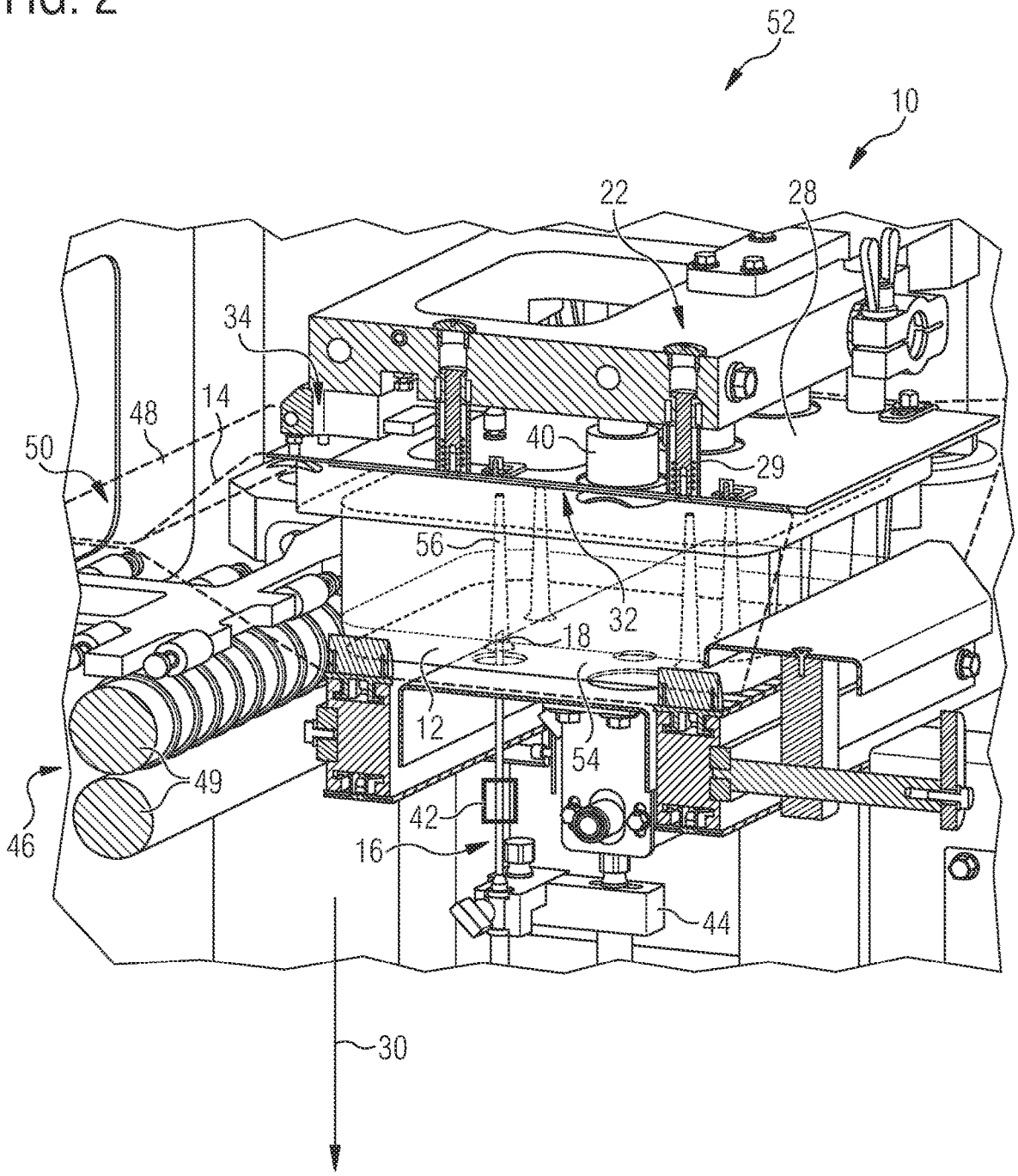
FIG. 2 a section of a perspective view of the device of FIG. 1.

FIG. 1 shows a perspective view of a device 10 and FIG. 2 shows a section of a perspective view of the device 10 of FIG. 1.

The device 10 is configured for removing a sterile object 12 from a foil bag 14.

In the present case, the object 12 is a tub, i.e., a tub-shaped object 12. The object 12 has four indentations 56 on its wall 54 oriented perpendicular to the direction of gravity 30. The indentations 56 extend from the wall 54 into the interior of the object 12. The indentations 56 extend along the direction of gravity 30, upwardly in FIGS. 1 and 2.

The device 10 has a needle unit 16 with a hollow needle 18. The needle unit 16 and/or the needle 18 are configured for piercing the foil bag 14.

The device 10 has a movement device 44 for this purpose. By means of the movement device 44, the needle unit 16 with the needle 18 can be moved back and forth along the direction of gravity 30. Thus, the needle unit 16 with the needle 18 for piercing the foil bag 14 can be moved against the direction of gravity 30, in FIGS. 1 and 2 upwards.

In doing so, the needle 18 is inserted into one of the four indentations 56 of the object 12. In other words, the needle 18 is engaged into one of the four indentations 54 of the object 12.

To withdraw the needle 18 from the foil bag 14, the needle unit 16 with the needle 18 can be moved in the direction of gravity 30, downward in FIGS. 1 and 2.

The device 10 includes a gas connection 20 disposed on the needle unit 16. By means of the gas connection 20, gas can be introduced into the foil bag 14 by the needle 18 when the latter has pierced the foil bag 14.

A filter device 42 is arranged on the needle unit 16. The filter device 42 can be used to remove possible impurities from the gas introduced into the foil bag 14.

The device 10 has a holding device 22 for holding the foil bag 14. The holding device 22 has a flat, planar and movably mounted holding unit 28. The holding unit 28 is oriented perpendicular to the direction of gravity 30.

The holding unit 28 has a square shape and is configured in the form of a metal sheet. The holding unit 28 is configured to be movable along the direction of gravity 30. The holding unit 28 is pretensioned in the direction of gravity 30 by means of four helical springs 29.

During inflation of the foil bag 14, the holding unit 28 contacts the upper region 32 of the foil bag 14 with respect to the direction of gravity 30, thereby forcing the upper region 32 of the foil bag 14 into a flat shape.

In the present case, the holding device 22 has a plurality of suction units 40 configured to suck and hold the foil bag 14 at its upper region 32.

The device 10 includes a cutting device 24 for cutting open the foil bag 14.

The device 10 includes a removal device 26 for removing the object 12 from the cut open foil bag 14.

The cutting device 24 and the removal device 26 are only schematically indicated in FIG. 1.

The device 10 comprises a fixing device 46. The fixing device 46 is configured to fix a lateral region 50 of the foil bag 14 with respect to the direction of gravity 30. For this purpose, the fixing device 46 has two clamping elements 49. The two clamping elements 49 are configured to clamp a flap 48 of the foil bag 14, which is arranged in the lateral region 50 of the foil bag 14.

Presently, the device 10 and the object 12 constitute a set 52.

Figure 3:
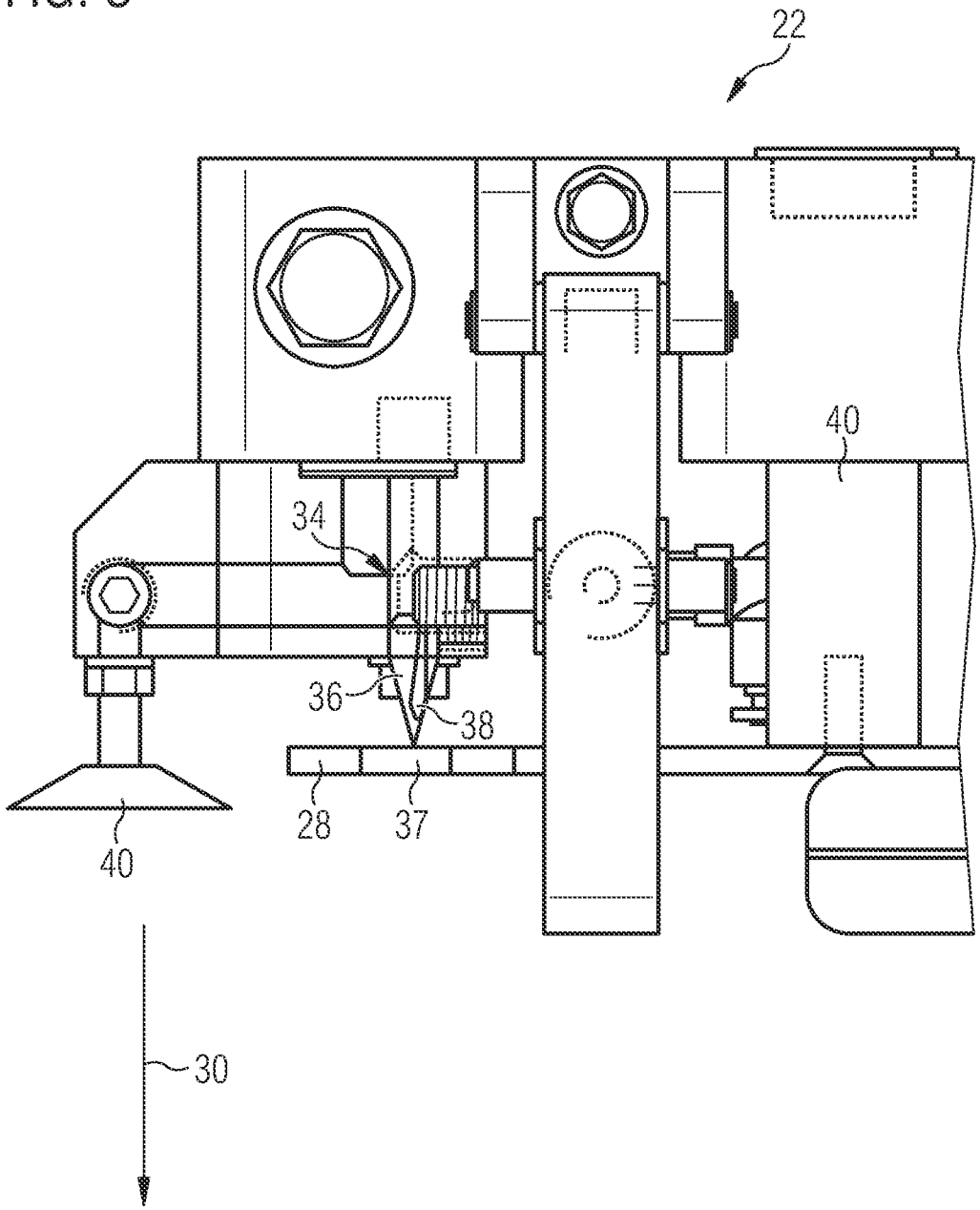
FIG. 3 a section of a side view of the device from FIG. 1.

FIG. 3 shows a section of a side view of the device 10 of FIG. 1.

In the present case, the holding device 22 has a piercing device 34 with a piercing needle 36 for piercing the foil bag 14.

The holding unit 28 has an opening 37 for passing the piercing needle 36 through the holding unit 28. Thus, when the holding unit 28 is moved upward (against the direction of gravity 30), the piercing needle 36 passes through the holding unit 28 through the opening 37.

The piercing needle 36 has an external groove 38 on its outer side. The external groove 38 is elongated and extends along the longitudinal direction of the piercing needle 36. Both the piercing needle 36 and the external groove 38 thus extend along the direction of gravity 30.

Removal of the object 12 from the foil bag 14 by means of the device 10 functions as follows:

The object 12 packaged in the foil bag 14 is positioned in the device 10. The needle unit 16 together with the needle 18 are moved from the bottom to the top (i.e. against the direction of gravity 30) by means of the movement unit 44 in FIGS. 1 and 2. The needle 18 is thus inserted into the indentation 56 of the object 12. The foil bag 14, which spans the indentations 56, is thereby pierced.

During and/or after piercing, gas is introduced into the foil bag 14 via the gas connection 20 via the needle 18. The gas is filtered by means of the filter device 42 before it is introduced into the foil bag 14 via the needle 18.

The foil bag 14 is inflated by the introduced gas. In the process, the upper region 32 of the foil bag 14 hits the holding unit 28 and pushes it upwards against the pretension of the four spiral springs 29 (i.e. against the direction of gravity 30).

This forces the upper region 32 of the foil bag 14 into a flat shape corresponding to the holding unit 28. Due to the now flat shape of the upper region 32, the suction units 40 of the holding device 22 can better engage with the upper region 32 of the foil bag 14 and better suck or hold it.

Further introduction of the gas through the needle 18 further inflates the foil bag 14. The upper region 32 of the foil bag 14 pushes the holding unit 28 further upwards (against the direction of gravity 30).

If the foil bag 14 is inflated beyond a desired level, the foil bag 14 pushes the holding unit 28 with its upper region 32 over the piercing needle 36. In doing so, the holding unit 28 with the opening 37 is moved over the piercing needle 36 so that the piercing needle 36 protrudes downwards (in the direction of gravity 30) from the opening 37. Here, the foil bag 14 is pierced in its upper region 32 by means of the piercing needle 36 protruding from the opening 37.

The gas can now escape from the foil bag 14 through the puncture point of the piercing needle 36. The escape of the gas is facilitated by the external groove 38. This can ensure that the foil bag 14 is not inflated beyond a desired level and thus always maintains a desired shape, particularly in its upper region 32.

The foil bag 14 is held in its upper region 32 by means of the suction units 40 of the holding device 22.

Since the desired shape of the foil bag 14 is maintained, the cutting of the foil bag 14 by means of the cutting device 24, as well as the fixing of the foil bag 14 by means of the fixing device 46, and the holding of the foil bag 14 by means of the holding device 22 are facilitated.

After the foil bag 14 has been inflated to the desired shape, the foil bag 14 is fixed in place by means of the fixing device 46. For this purpose, the flap 48 of the foil bag 14 is fixed in a clamping manner by means of the two clamping elements 49. This stretches the region between the flap 48 and the upper region 32 of the foil bag 14, so that the foil bag 14 can be cut open particularly well in this stretched region by means of the cutting device 24.

After the foil bag 14 has been cut open, the object 12 is removed from the foil bag 14 by means of the removal device 26. For this purpose, the removal device 26 has several suction elements 27. The removal device 26 moves the suction elements 27 into the cut open foil bag 14. The suction elements 27 engage a wall of the object 12 and suck themselves thereon. This fixes the object 12 to the removal device 26 or its suction elements 27. Subsequently, the suction elements 27 and thus the object 12 are moved out of the cut open foil bag 14.

Prior to the removal of the object 12 from the foil bag 14 and after the foil bag 14 has been cut open, the needle 18 is removed from the indentation 56 of the object 12 by the movement device 44 moving the needle unit 16 together with the needle 18 downwards (in the direction of gravity 30). Otherwise, the needle 18 arranged in the indentation 56 would hinder removal of the object 12.

The cut open and empty foil bag 14 can be disposed of after the removal of the object 12. This can be implemented, for example, by means of the fixing device 46, which transports the fixed, cut open and empty foil bag 14 to a disposal location. For this purpose, the fixing device 46 can be configured to be correspondingly movable.

What is claimed is:

1. A device (10) for removing a sterile object (12) from a foil bag (14), the device comprising:

a needle unit (16) with a hollow needle (18) for piercing the foil bag (14), a gas connection (20) arranged on the needle unit (16) for introducing gas via the hollow needle (18) into the foil bag (14), a holding device (22) for holding the foil bag (14)

a cutting device (24) for cutting open the foil bag (14), and a removal device (26) for removing the object (12) from the cut open foil bag (14), wherein the holding device (22) has at least one holding unit (28), which is formed on the holding device (22) in a planar manner and is movably mounted, for contacting the foil bag (14), and wherein the holding unit (28) is oriented perpendicular to the direction of gravity and is configured to press the upper region of the foil bag (14) in relation to the direction of gravity into a flat shape.

2. The device (10) according to claim 1, wherein the holding unit (28) is a metal sheet.

3. The device (10) according to claim 1, wherein the holding device (22) has at least one piercing device (34) with a piercing needle (36) for piercing the foil bag (14) and for discharging from the foil bag (14) the gas introduced into the foil bag (14) by the needle (18).

4. The device (10) according to claim 3, wherein the piercing needle (36) comprises at least one external groove (38) for discharging from the foil bag (14) the gas introduced by the needle (18) into the foil bag (14).

5. The device (10) according to claim 1, wherein the holding device (22) comprises at least one suction unit (40) for sucking and/or holding the foil bag (14).

6. The device (10) according to claim 1, wherein the needle unit (16) comprises a filter device (42) for filtering the gas introduced into the foil bag (14) by the needle (18), the filter device (42) being arranged inside the needle (18) and/or inside the gas connection (20).

7. The device (10) according to claim 1, wherein the device (10) comprises a movement device (44), the movement device (44) being configured to move the needle unit (16) and/or the needle (18) for piercing the needle (18) into the foil bag (14) and for withdrawing the needle (18) from the foil bag (14).

8. The device (10) according to claim 1, wherein the device (10) has a fixing device (46) for fixing a lateral region (50) of the foil bag (14) with respect to a direction of gravity (30).

9. The device (10) according to claim 8, wherein the fixing device (46) comprises at least two clamping elements (49) which are configured to fix the foil bag (14) in a clamping manner.

10. A set (52) comprising a device (10) according to claim 1 and at least one object (12), which is surrounded by a foil bag (14), wherein the object (12) has at least one indentation (56), the device (10) and/or the object (12) being configured in such a way that the needle (18) for piercing the foil bag (14) is inserted at least partially into the indentation (56) of the object (12).

11. The set (52) according to claim 10, wherein the holding unit (28) projects beyond the object (12) on at least one side of the object (12).

12. A method for removing a sterile object (12) from a foil bag (14), comprising the steps:

providing the object (12) arranged in the foil bag (14);

piercing the foil bag (14) by a hollow needle (18);

introducing gas via the needle (18) into the foil bag (14);

holding the foil bag (14) by a holding device (22), the holding device (22) having at least one holding unit (28), which is formed on the holding device (22) in a planar, in particular flat, manner and is movably mounted, for contacting the foil bag (14) and wherein the holding unit (28) is oriented perpendicular to the direction of gravity and is configured to press the upper region of the foil bag (14) in relation to the direction of gravity into a flat shape;

contacting the foil bag (14) by the holding unit (28);

after contacting the foil bag (14) by the holding unit (28), further introducing gas via the needle (18) into the foil bag (14) so that the foil bag is further inflated and moves the holding unit (28).

13. The method according to claim 12, wherein the method comprises the step of: while introducing gas via the needle (18) into the foil bag (14), piercing the foil bag (14)

to discharge the gas introduced by the needle (18) into the foil bag (14) from the foil bag (14).

14. The method according to claim 12, wherein the method comprises the steps of: cutting open the foil bag (14) inflated by the needle (18) and held by the holding device (22); and removing the object (12) from the foil bag (14).

15. The device (10) according to claim 1, wherein the sterile object is a tub.

16. The method according to claim 14, further comprising disposing of the empty and cut open foil bag (14).

17. The device (10) according to claim 3, wherein the at least one piercing device (34) pierces the foil bag (14) in an upper region (32) of the foil bag with respect to a direction of gravity (30).

18. The device (10) according to claim 5 wherein the at least one suction unit (40) includes a suction cup.

19. The device (10) according to claim 8, wherein the lateral region (50) of the foil bag (14) has a flap.

* * * * *